US005676065A

United States Patent [19]

Locker

[11] Patent Number: 5,676,065

[45] Date of Patent: Oct. 14, 1997

[54] FLATRACKS AND LOAD-CARRYING SYSTEMS

[75] Inventor: Stephen William Locker, Stramshall, England

[73] Assignee: Cargotec (UK) Limited, Shrewsbury, England

[21] Appl. No.: 496,029

[22] Filed: Jun. 28, 1995

[30] Foreign Application Priority Data

Jul. 6, 1994 [GB] United Kingdom ..... 9413609

[51] Int. Cl.[6] ..... B65D 19/00

[52] U.S. Cl. ..... 108/55.1; 108/51.1

[58] Field of Search ..... 108/51.1, 54.1, 108/55.1, 56.1, 83

[56] References Cited

U.S. PATENT DOCUMENTS

| | | | |
|---|---|---|---|
| 1,317,550 | 9/1919 | Cass | 108/54.1 X |
| 2,523,271 | 9/1950 | Bartel | 108/55.1 X |
| 3,336,882 | 8/1967 | Edelson | 108/83 X |
| 3,993,344 | 11/1976 | Bennett | 108/55.1 X |
| 4,068,599 | 1/1978 | Sapp et al. | 108/55.1 |
| 4,353,520 | 10/1982 | Jansson . | |
| 4,917,557 | 4/1990 | Kato et al. | 108/56.1 X |
| 5,259,325 | 11/1993 | Pilger | 108/55.1 |

FOREIGN PATENT DOCUMENTS

| | | | |
|---|---|---|---|
| 0 208 624 | 1/1987 | European Pat. Off. . | |
| 3140358 | 4/1983 | Germany . | |
| 783133 | 12/1980 | U.S.S.R. | 108/54.1 |
| 1495233 | 7/1989 | U.S.S.R. | 108/54.1 |
| 2 170 185 | 7/1986 | United Kingdom . | |
| 2 247 664 | 3/1992 | United Kingdom . | |
| 2 263 684 | 8/1993 | United Kingdom . | |
| 2 246 161 | 1/1994 | United Kingdom . | |
| WO 93/18934 | 9/1993 | WIPO . | |

*Primary Examiner*—Jose V. Chen

*Attorney, Agent, or Firm*—Perman & Green, LLP

[57] ABSTRACT

Sundry advantageous designs of mini-flatrack are shown. A mini-flatrack is one whose length is substantially half that of a conventional I.S.O. "6 meter" or "20 foot" flatrack. Mini-flatracks can be joined end-to-end, or have their length increased by interpolating a panel. The hook bar may be made vertically adjustable relative to the load-supporting surface.

3 Claims, 9 Drawing Sheets

FLATRACKS AND LOAD-CARRYING SYSTEMS

This invention relates to a flatrack and to load-carrying systems. Flatracks, sometimes called exchange platforms, are in effect load-carrying pallets that can be transported on vehicles, particularly road vehicles and rough terrain internal-combustion-engine-powered vehicles. One example of a known flatrack is illustrated in FIGS. 13 and 14 of European Patent Application No. 107892 and another is seen in U.S. Pat. No. 4,589,671. Flatracks are conventionally approximately 6 meters (20 feet) in length and about 2.5 meters in width and carry loads of about 16 to 18 tonnes. Flatracks are build to the standard I.S.O. dimensions and design requirements so that they can be handled if necessary by I.S.O. container handling equipment as installed at most major ports and depots throughout the world.

It has become apparent that it would be desirable if there was available a system of load handling, using flatracks, which is more versatile and flexible than that available hitherto, and which enables smaller loads than 16 tonnes as well as a full 20 foot (6 meter) load to be transported and handled.

In accordance with one aspect of the invention, there is provided a flatrack comprising a base portion, an A-frame portion, and a fold-over portion, the base portion having at its end remote from the A-frame portion, and the fold-over portion being pivotable about a horizontal axis between a housed position and an extended position in which it provides an extension of the load-carrying surface of the base portion.

In accordance with a particular embodiment of the aspect of the invention, an extension on such a mini-flatrack is constructed to be pivoted about a transverse horizontal axis disposed at or near the rear end of the mini-flatrack. This provides a pivoting extensibility as compared to the linear extensibility referred to below.

In accordance with another aspect of the invention, there is provided a flatrack, herein called a mini-flatrack, which has a length substantially half that of the standard 6 meter flatrack and which has thereon an extensible and retractible load carrying extension, said extension being constructed so that the mini-flatrack with its extension extended and a horizontal panel interpolated has a length of substantially 4.5 meters, and is sufficiently rigid to reliably support a load of about 6 to 9 tonnes. The extension may include slidable beams, capable of endwise movement, made captive to the mini-flatrack and having mechanisms thereon whereby they can be locked to the remainder of the mini-flatrack in respective extended and retracted positions. Alternatively, the interpolated panel may be locked to the flatrack by a locking mechanism. An important advantage of this aspect of the invention is that such a mini-flatrack can cope with a variety of loads and can be carried by vehicles of different sizes.

According to yet a further aspect of the invention, there is provided a flatrack constituted by a pair of mini-flatracks each having an integral upstanding end-frame, wherein each of the end frames includes connection means whereby the mini-flatracks can be rigidly connected end-frame to end-frame.

According to another aspect of the invention, there is provided a flatrack constituted by a pair of mini-flatracks each having an integral upstanding end-frame, wherein the respective ends of the mini-flatracks remote from the end-frames each have connection means for connecting the two mini-flatracks rigidly together.

According to a further aspect of the invention, there is provided a flatrack having an integral upstanding end-frame at one end thereof, wherein the end-frame includes a hook bar extending between two vertical pillars, the pillars being mounted for joint vertical upward or downward adjustment of their position relative to the remainder of the end-frame.

According to yet a further aspect of the invention, there is provided a method and apparatus for handling flatracks. Two such flatracks can be handled separately by loading equipment. The ends of these which are to be placed against each other are provided with at least one connecting means, so that they can be connected together, and thus connected the flatracks are moved onto a vehicle or removed from a vehicle as one unit by causing a hook of a loading handling system (such as that shown in the said EP-A-107892) to engage with the hook bar or equivalent component of the foremost flatrack.

In such a system according to this aspect of the invention no such separate bases are needed onto which the flatracks would be lifted, nor any loose additional connectors for connecting the flatracks together. The two combined flatracks connected in accordance with the invention can be lifted onto a vehicle equipped with a load handling system. The combined flatracks if desired can be moved from the vehicle onto a trailer.

The flatracks can be connected to each other simply by reversing the vehicle into position, whereby the vehicle pushes the flatrack on the vehicle towards the other one and the opened locking means of the connecting means will close automatically. For connecting, the driver of the vehicle need not leave the cab of the vehicle. In other words, this aspect of the invention provides a combination formed by at least two flatracks, wherein both flatracks are provided with at least one hook bar or equivalent component and each flatrack can be handled separately by the load handling system of the vehicle, which is equipped with at least one hook or the like for engaging with the hook bar at the front end of the flatrack. In such an arrangement, the flatrack ends to be fitted against each other are equipped with at least one connecting means for connecting the flatracks to each other so that the combination formed by the flatracks can be handled as one unit by the load handling system.

Examples of the invention will be better understood from the following non-limiting descriptions given with reference to the accompanying drawings in which like parts are denoted by like reference numerals; and in which:

FIGS. 5A to 7A are plan views of a flatrack which can be linearly extended, and FIGS. 5B to 7B are corresponding side elevation views, FIGS. 7A and 7B showing a panel interpolated to provide a continuous load-bearing surface;

Figure 15:
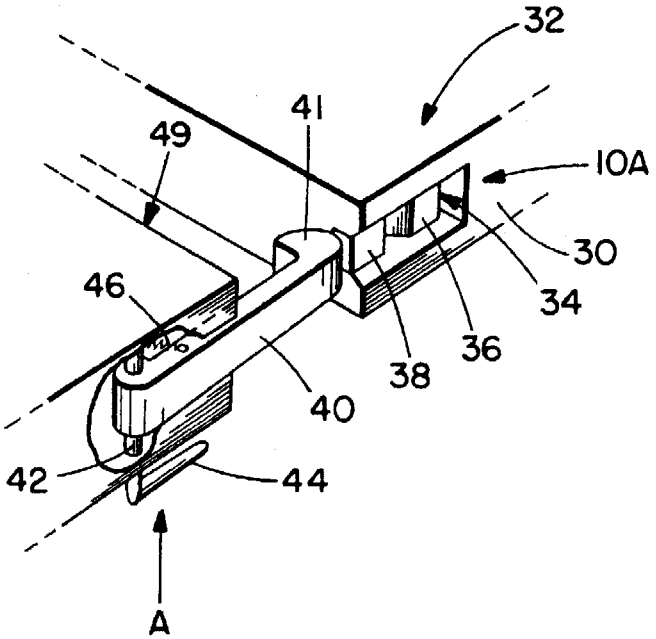
Figure 16:
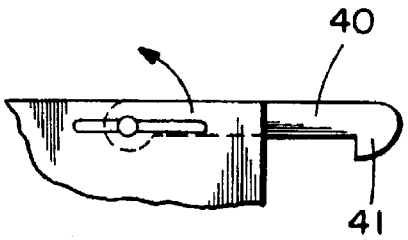
Figure 8:
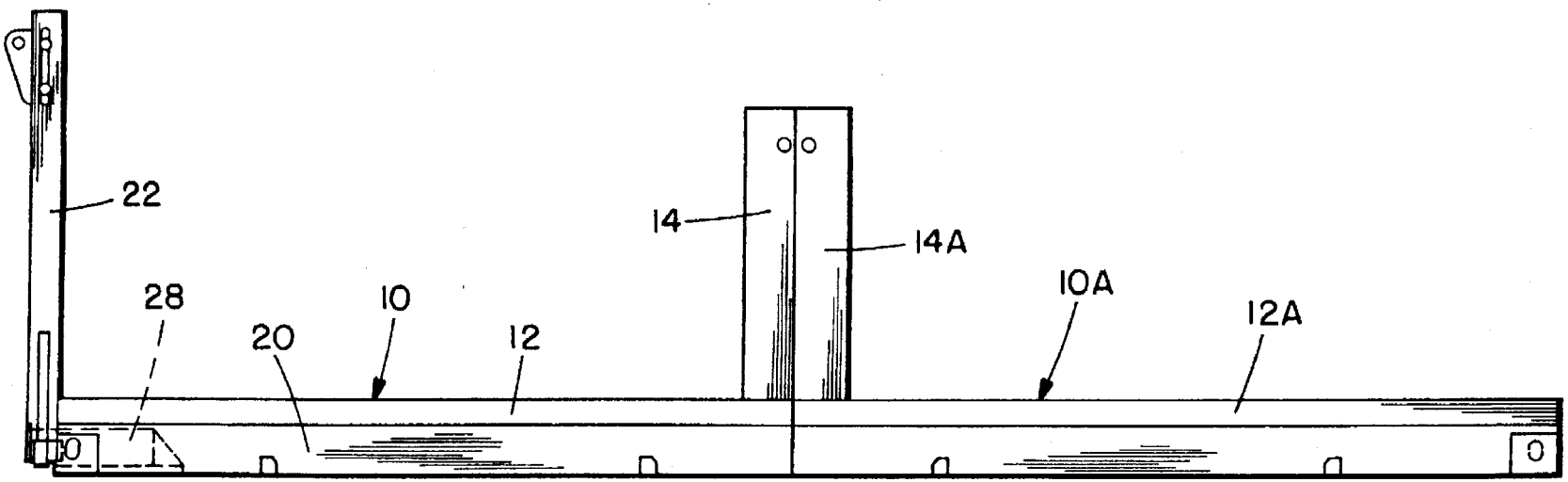
FIG. 8 is a side elevation showing two mini-flatracks joined end-frame to end-frame and carried on an I.S.O. "20 foot" (6 meter) flatrack.
Figure 10:
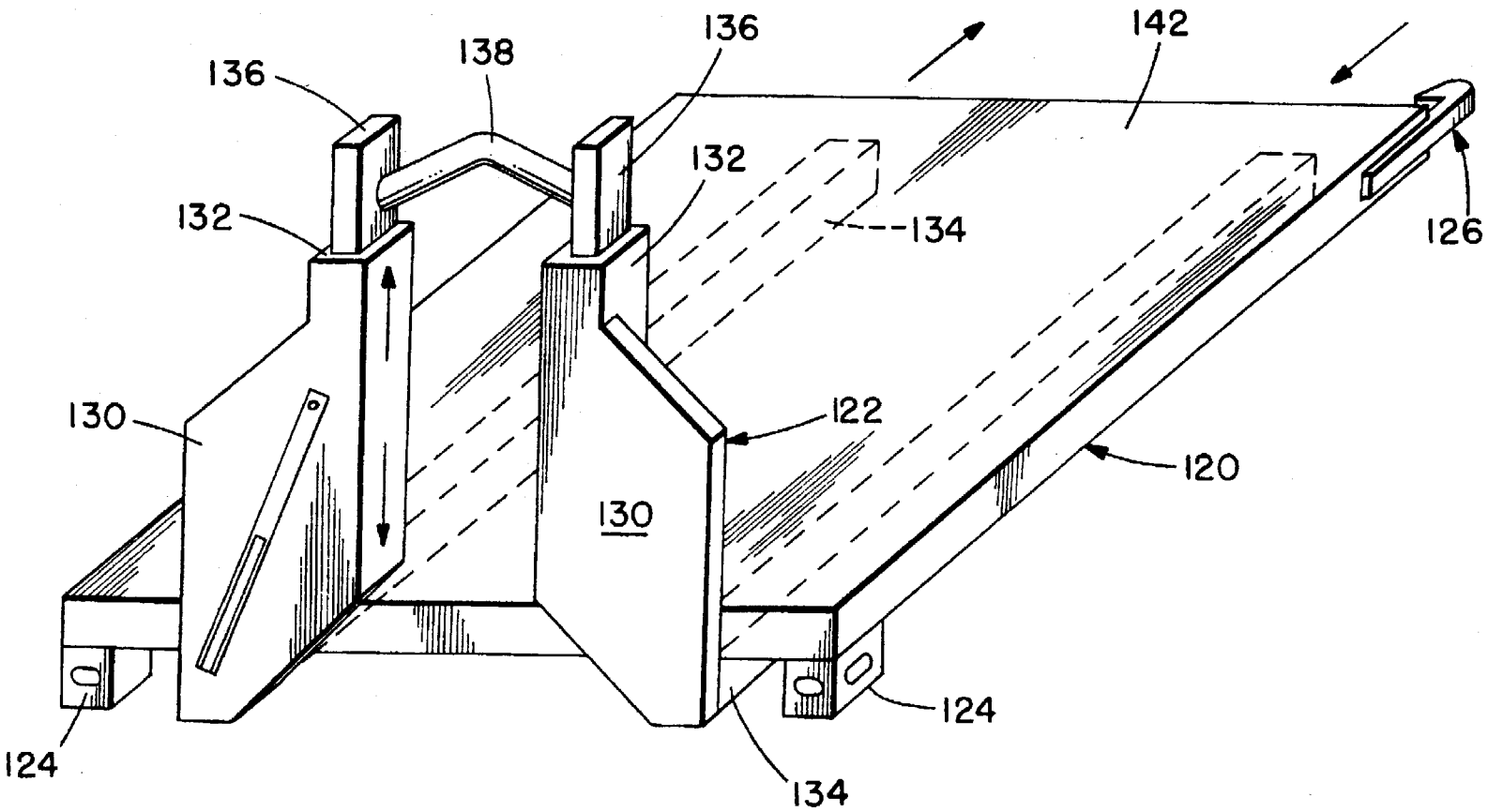
Figure 11:
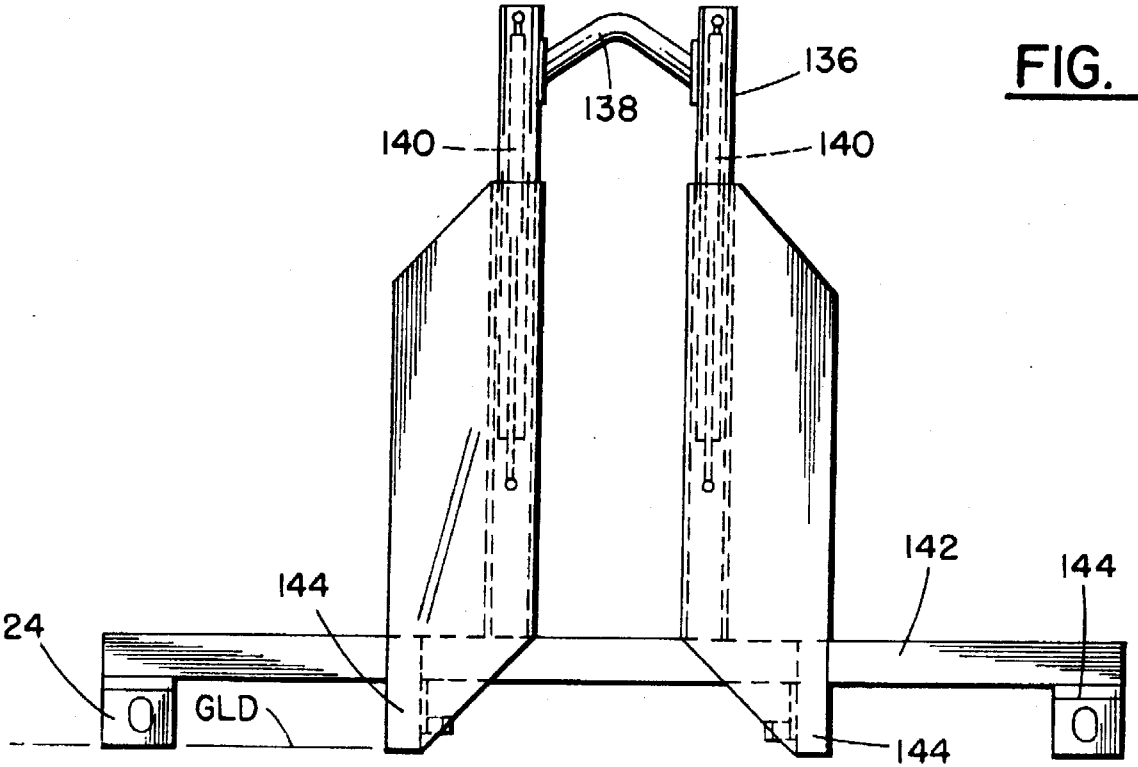
Figure 12:
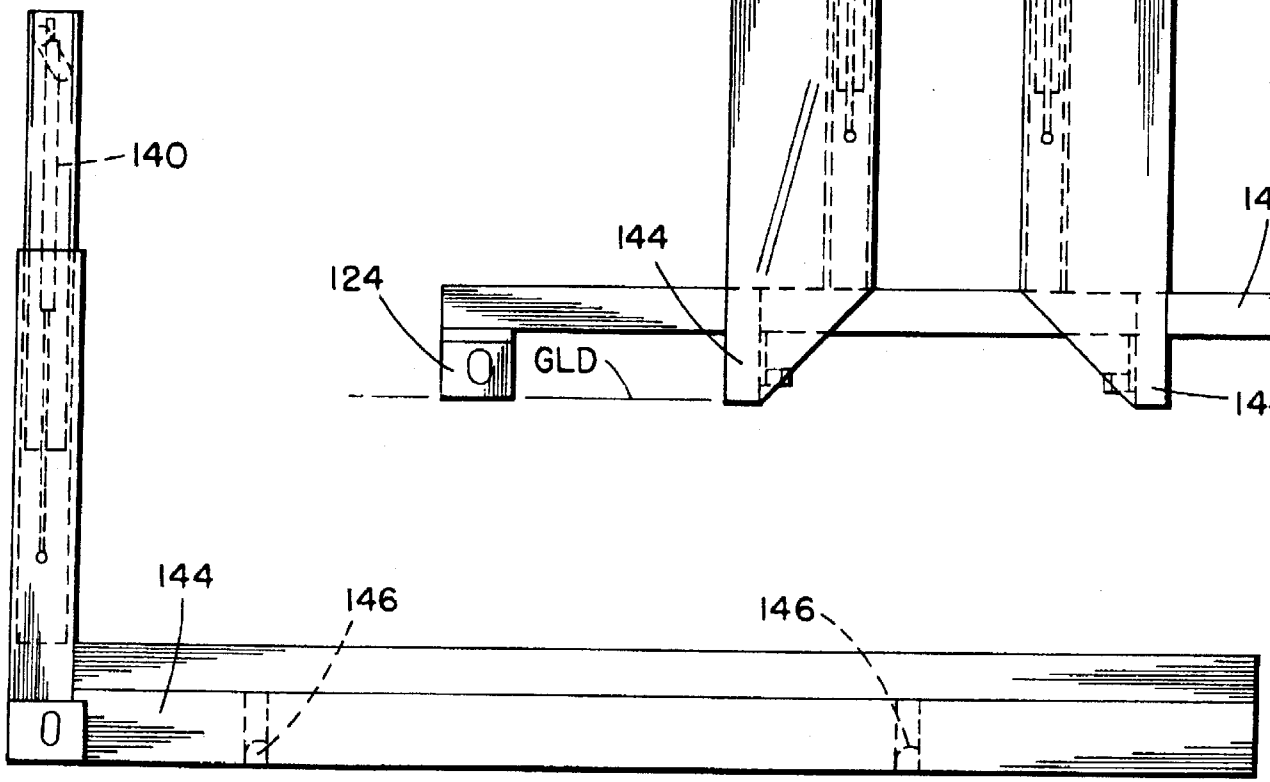
Figure 13:
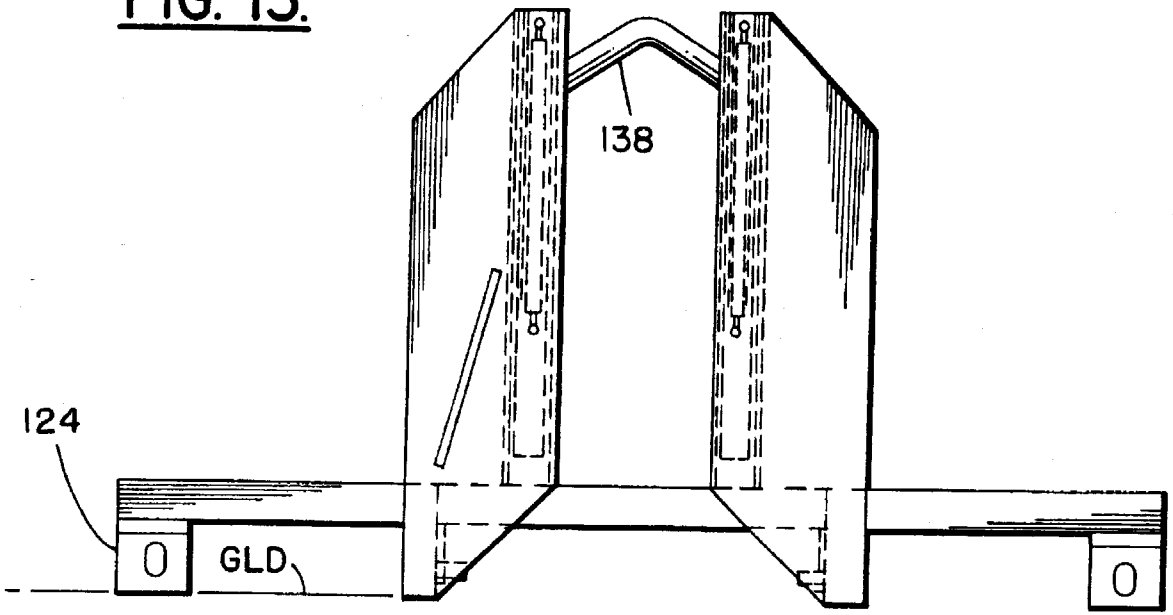
Figure 14:
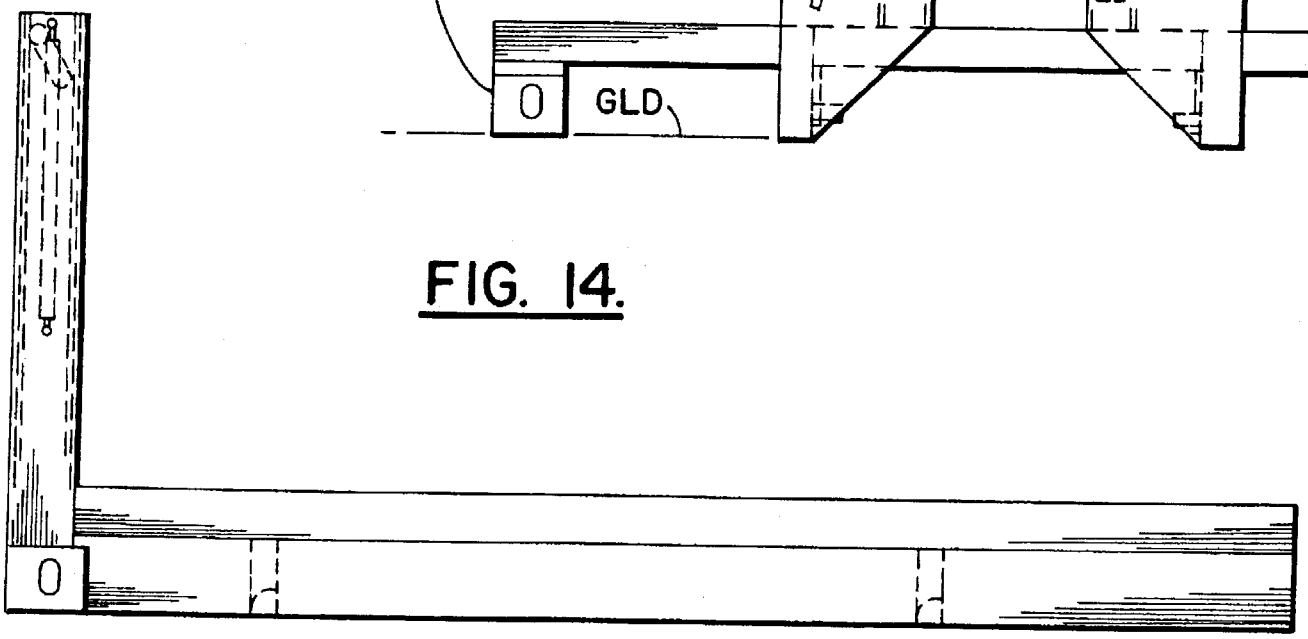

FIG. 10 is an isometric view illustrating a flatrack having a vertically adjustable hook bar; this flatrack being shown in more detail in FIGS. 11–14 of which FIGS. 11 and 12 are end views and FIGS. 13 and 14 side elevations; and FIGS. 15 and 16 show details of a connection mechanism useful for joining two flatracks of the kind illustrated in FIG. 8.

Figure 1:
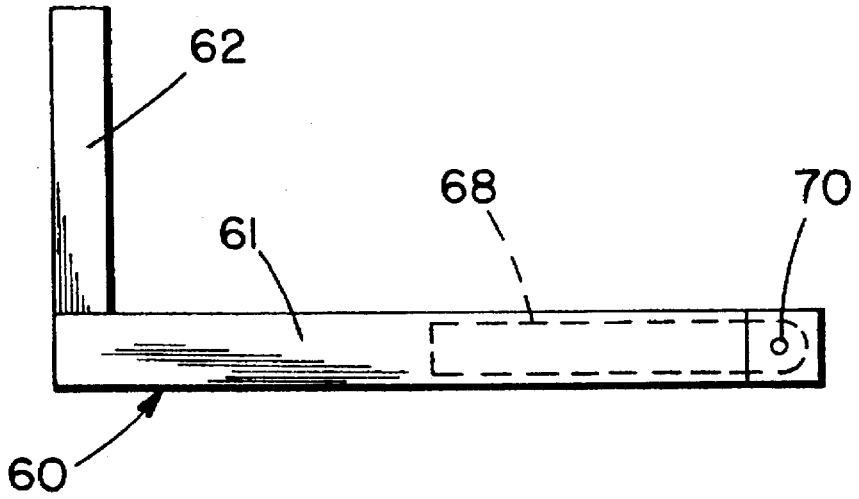
FIG. 1 is a schematic side elevation of a mini-flatrack according to a first embodiment of the invention.
Figure 2:
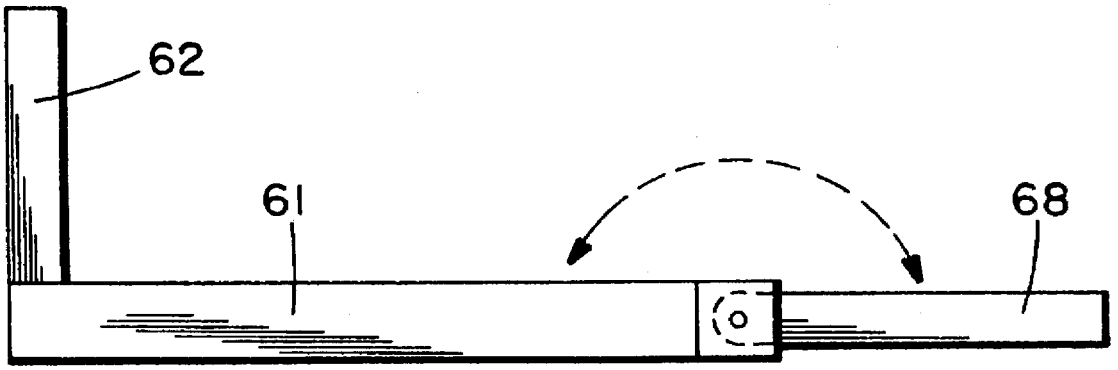
FIG. 2 is a similar view to FIG. 1 but showing an extension of the mini-flatrack which has been pivoted to its working position to enlarge the load carrying capacity of the mini-flatrack of FIG. 1.
Figure 3:
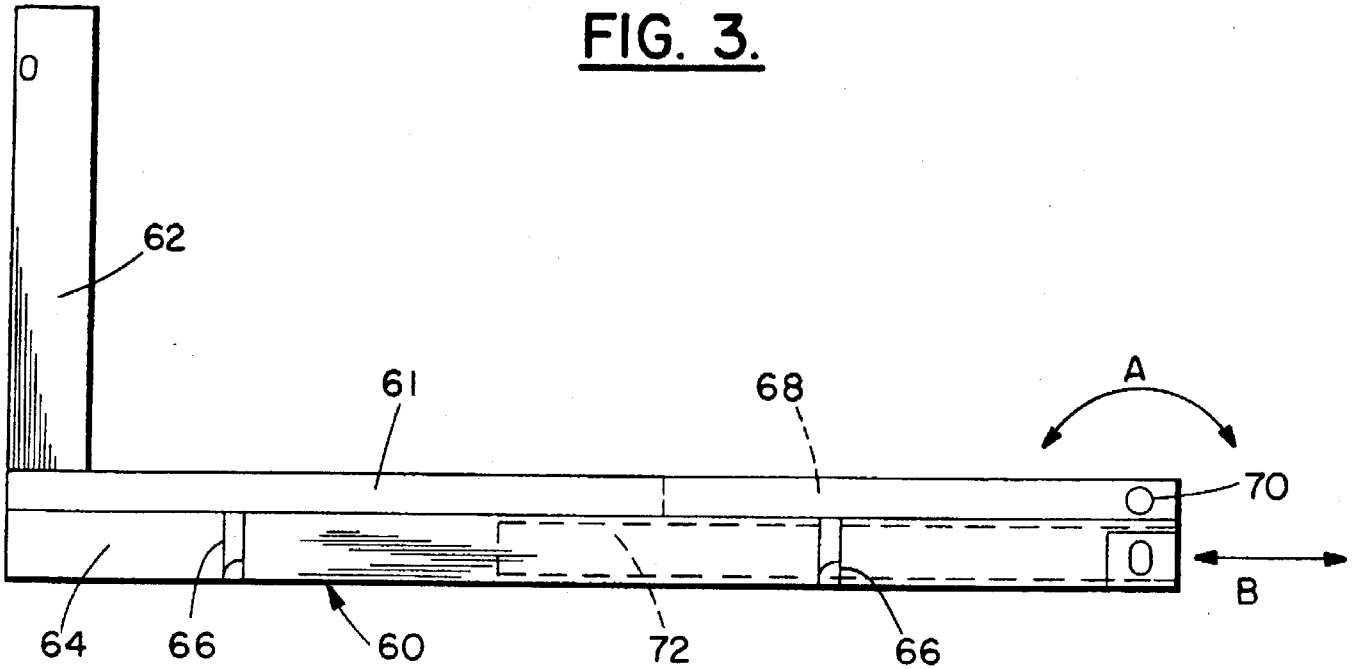
FIG. 3 is a somewhat more detailed view of the mini-flatrack shown in FIG. 1 and FIG. 2.
Figure 4:
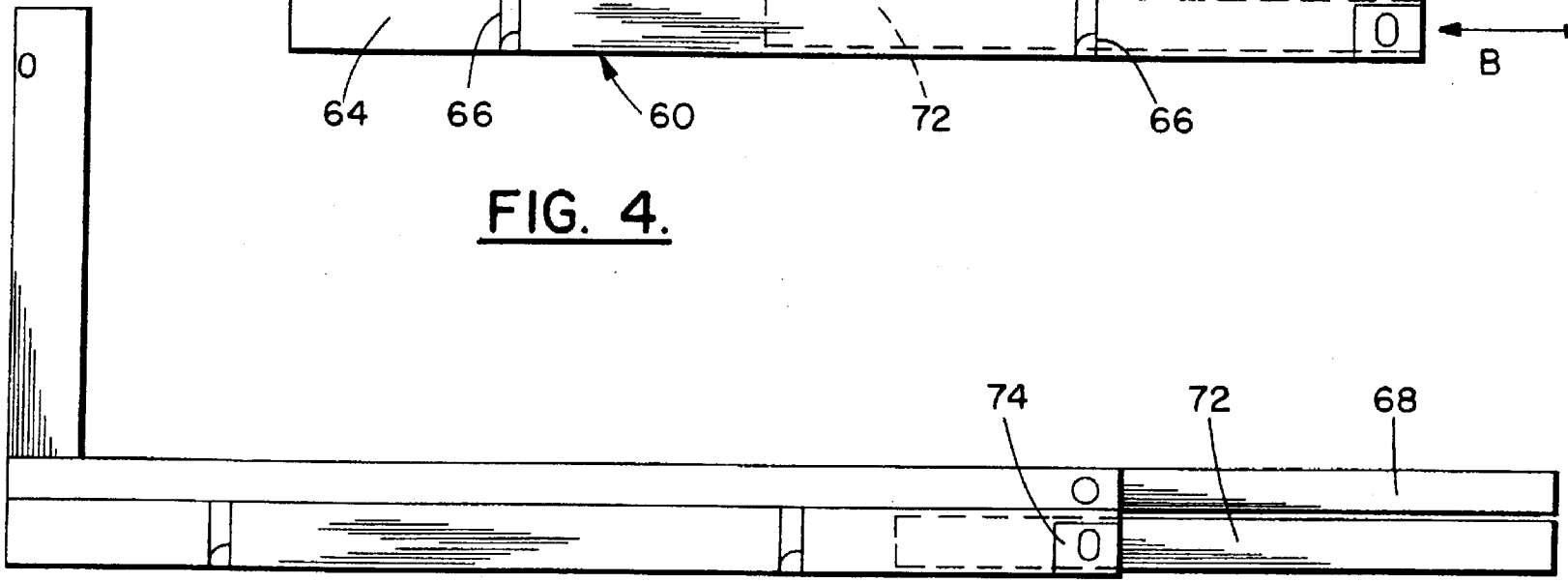
FIG. 4 is a side elevation view similar to FIG. 3 showing the extension in its open (working) position.
Figure 6A:
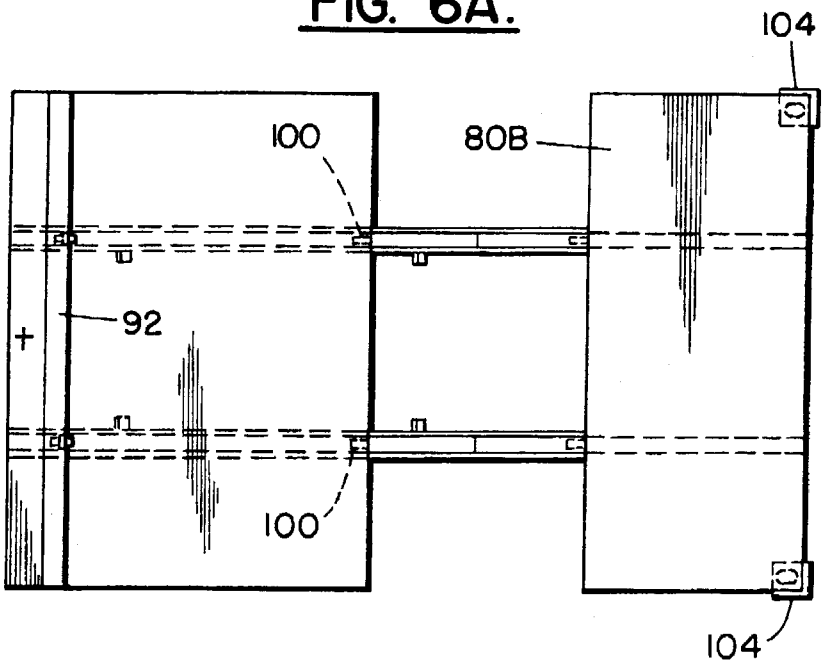
Figure 6B:
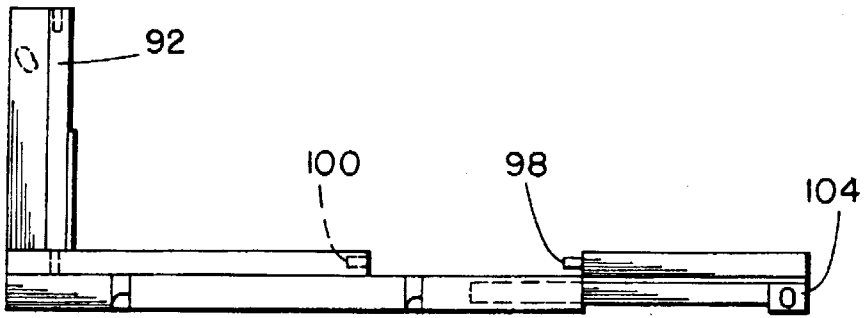

The mini-flatrack 60 illustrated in FIGS. 1 and 2 and in more detail in FIGS. 3 and 4 includes a base 61 and an end-frame (A-frame) 62 at one end thereof. Longitudinal beams, one shown at 64, support the base 60, and cross beams 66 are welded to the beams 64. An extension 68 can be piloted between two positions, the first position being a retracted position as illustrated in FIGS. 1 and 3 and the second position being an extended position as seen in FIGS. 2 and 4. The extension 68 is mounted on a pivot shaft 70 which extends across the mini-flatrack. The extension 68 essentially comprises a flat plate. A slidable beam structure 72 can be longitudinally slid, as indicated by arrow B in FIG. 3, between an extended position (FIG. 4) in which it supports the extension 68 and a retracted position, FIG. 3. Conventional I.S.O. corner castings 74 may be included. The pivoting movement of the extension 68 is illustrated by the double headed arrow A in FIG. 3.

This example of mini-flatrack has the advantage that its load carrying capacity can be increased in a very rapid and trouble free manner. Merely by pivoting the extension 68 about the shaft 70 so that it takes up the FIG. 4 position, one may convert the mini-flatrack so that it can carry a load which is approximately 1.5 times as great as would be possible on the "3 meter" mini-flatrack 10 in accordance with FIG. 8.

Referring next to FIGS. 5A–7A and 5B–7B, these show an embodiment of the invention wherein a mini-flatrack is coupled with a like flatrack. This combination is arranged to have an overall configuration, so far as the corner castings are concerned, such that these corner castings are located in exactly the same positions as would be the case in a conventional "20 foot" (or "6 meter") I.S.O. flatrack.

The flatrack illustrated in FIGS. 5A–7B has a load supporting surface 80, and an end-frame 82. The position of the apex of the hook bar thereon is indicated at 84. The load supporting surface 80 is supported by longitudinal beams, one of which is shown at 86 and cross beams 88. These cross beams 88 are welded to the longitudinal beams 86. The load supporting surface 80 is divided into two portions, 80A and 80B, and the portion 80B is attached to beams 90 which are longitudinally slidable relative to the beams 86. FIGS. 6A and 6B illustrate the elongated condition of the flatrack produced by rightward movement of the portion 80B.

Figure 5A:
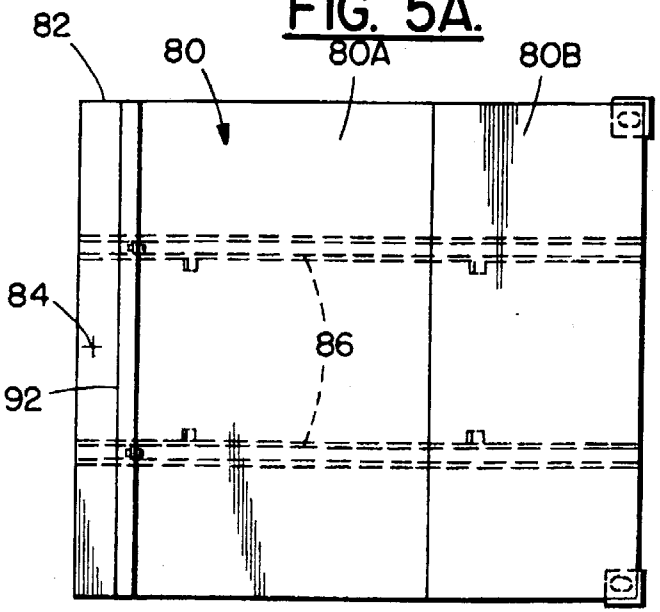
Figure 5B:
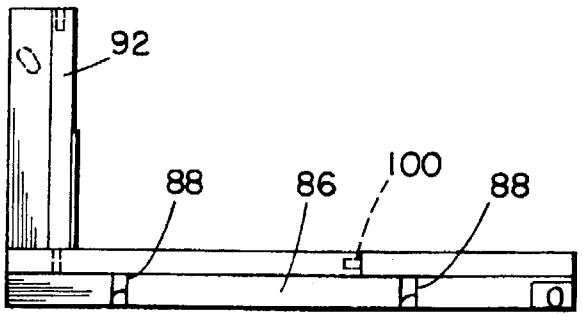

In order to enable the flatrack to carry a larger load than is possible when it is in its configuration according to FIGS. 5A and 5B, an intervening load supporting panel 92 is introduced. When not used as a supporting surface, the panel 92 is stored in the location shown in FIGS. 5A, 5B, 6A and 6B.

Figure 7A:
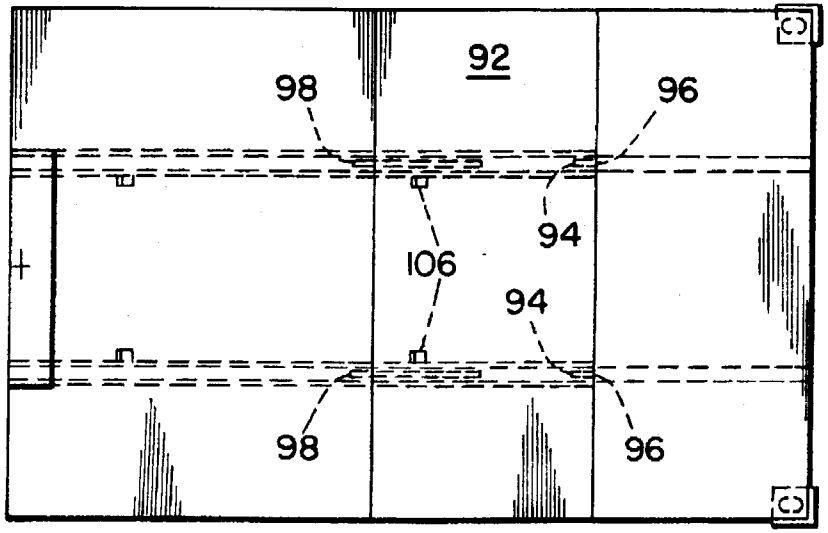
Figure 7B:
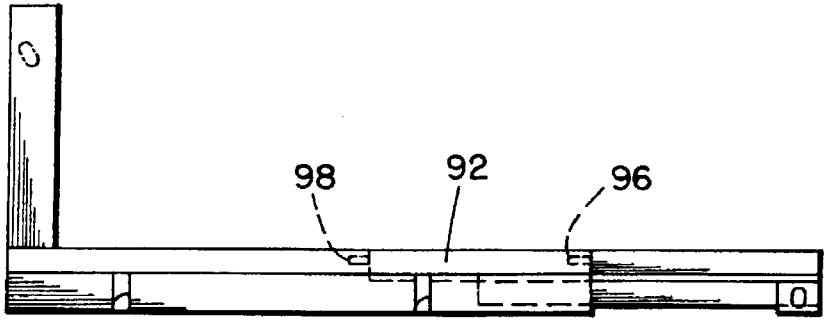

The panel 92 is provided with recesses 94 at its rear edge which can receive lugs 96 which project from the forward surface of the base panel portion 8OB. The panel 92 also has slidable catches, 98, longitudinally movable between extended and retracted positions. In their extended positions these catches extend into complementary recesses in the base portion 80A, one such recess being indicated at 100 in FIG. 5B, in order to firmly secure the interposed load supporting panel 92 in position. The lugs 96 extend forwardly from the forward edge of the load supporting base 80B to engage in the recesses 94 in the rear edge of the additional panel 92. Thus, as seen in FIGS. 7A and 7B, once the catches 98 are forwardly extended into the recesses 100, as may be achieved for example by a suitable lever or rack and pinion mechanism, the panel 92 is held in position as an integral part of the overall load supporting surface comprising, as seen in FIGS. 7A and 7B, portions 80A, 92 and 80B. Standard I.S.O. corner castings 104 (two on each mini-flatrack) are included so that a pair of identical mini-flatracks as seen in FIG. 5A, joined end-frame to end-frame, can be handled by conventional I.S.O. flatrack or container handling equipment. The lever or rack and pinion mechanism by which the lugs 98 are extended is shown at 106 in FIG. 7A.

While the mini-flatracks shown in FIGS. 3 and 4 are not shown as provided with any mechanism for coupling them in pairs end-to-end, of course a suitable mechanism for this purpose could be included. That is to say, a mini-flatrack in accordance with FIG. 3 could be provided additionally, for example, with a coupling arrangement of the kind illustrated in FIGS. 15 and 16. In this way, a particularly versatile mini-flatrack, able to cope with a variety of sizes of load and yet able to be handled in a fully conventional way, by standard I.S.O flatrack-handling equipment, is provided.

Figure 9:
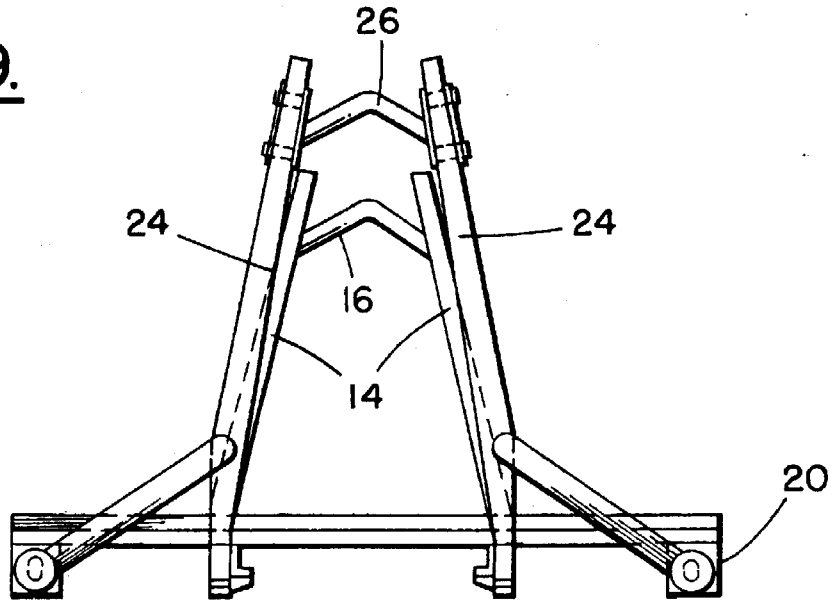
FIG. 9 is an end view of the arrangement of FIG. 8 showing the respective end-frames (A-frames) of the I.S.O. "20 foot" flatrack and the left-hand mini flatrack.

Referring now to FIGS. 8 and 9, each of the illustrated mini-flatracks 10, 10A has a base portion 12, 12A and an A-frame portion 14, 14A. The A-frame portions 14 and 14A are upstanding from one end of a respective base portion and each has a hook bar 16. These are provided so that the mini-flatrack can be manipulated by a load handling system, such as the load handling system illustrated in European Patent Application No. 107892A.

As seen in FIGS. 8 and 9, the flatracks 10 and 10A are carried by a larger (20 ft. I.S.O.) flatrack 20. This has a detachable upstanding A-frame 22 Comprising two angled beams 24 located in a vertical plane joined by a hook bar 26. The A-frame 22 has projecting lugs 28 by which it can be secured to the flatrack 20. The flatracks 10, 10A are secured together end-frame 14 to end-frame 14A, for example by bolts, not shown. Alternatively they may be secured together by suitable latches. The construction and arrangement of the bolts or latches will be clear to the skilled reader. Flatracks such as those shown at 10 and 10A may be fixed together free-end to free-end by a connection mechanism whose details are shown in FIGS. 15 and 16.

As seen In FIG. 15, one flatrack 10A has a sidewall 30 and a load-bearing surface 32. A recess 34 in the sidewall is provided with two outwardly projecting teeth 36, 38. These teeth are provided to co-operate with a pivotable hook member 40. This can rotate about a vertical pin 42 fixed to the other flatrack 10. The ends of the pin 42 have cam surfaces which engage with suitable fixed confronting surfaces on the flatrack 10. A handle 44 is provided to rotate the pin 42 and the cam surfaces carried by it. A tension spring 46 urges the hook member 40 in an anticlockwise direction as seen in FIG. 15. The cam surfaces are substantially snail cams and rotation of a handle 48, connected to the pin 42, causes the vertical axis of the pin 42 to be shifted towards or away from the edge of the flatrack 10, according to the direction of rotation. In use, the handle 44 is rotated fully anticlockwise which results in the pin 42's axis being shifted towards the edge 49. The two flatracks 10 and 10A are then moved together so that the hook tip 41 is pushed away from the flatrack 10 by the surface on the tooth 38, following which the hook tip moves into the recess between teeth 36 and 38 under the tension of the spring 46. Once the tip is fully engaged with the tooth 38, the pin 42 is rotated through up to 180 degrees by turning the handle in the opposite rotational direction, so shifting the axis of the pin 42 in a direction away from the edge 49. This action of course pulls the hook 40 and the flatrack 10A towards the flatrack 10, so securely coupling them together. Each flatrack 10, 10A has a hook 40 and the described associated arrangement on one forward corner only, so that tightening of both hooks results in the two flatracks being securely held together.

Mini-flatracks such as those shown at 10, 10A in FIG. 8 can either be used separately, being carried by suitable small vehicles, or they can be coupled together as illustrated and then used in the manner conventional for a so-called 20 foot mini-flatrack, that is to say, they can be manipulated by heavy duty vehicles or other flatrack handling apparatus complying with I.S.O. standards.

A mini-flatrack 10 as shown in FIG. 8 includes a base 12 and an A-frame 14. The base 12 may consist of a number of parallel beams and it may or may not have a cover plate or cover surface according to whether this is needed for the load to be carried. At this point it may be noted that not all mini-flatracks are provided with an A-frame. Accordingly, in suitable situations, the A-frame could be dispensed with. In that event, a hook bar is attached to the front end, or to both ends, of the base 12, to permit loading of the mini-flatrack by a load handling system of the kind indicated for example in PCT Application WO-93/18934.

Figure 8A:
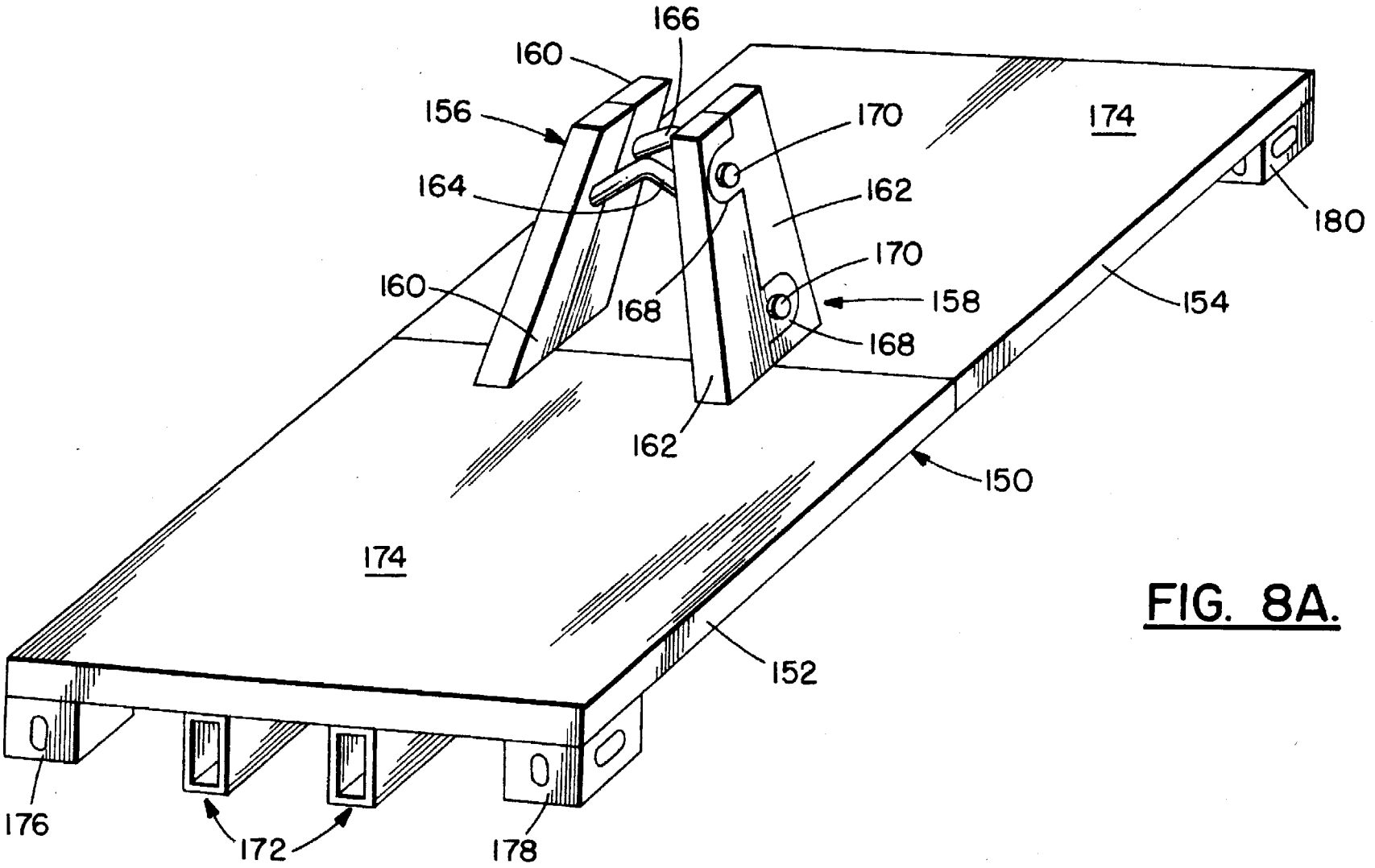
FIG. 8A shows, in perspective view, a flatrack made up of 2 mini-flatracks, each having an A-frame at one end, joined A-frame to A-frame, with provision for insertion of a further A- frame.

Referring now to FIG. 8A, a flatrack 150 made up of two connected mini-flatracks 152, 154 is shown. Each mini-flatrack has an A-frame 156, 158 at one end which includes upstanding pillars 160, 162 and respective hook bars 164, 166. A bracket 168 with a central hole 170 is attached to each of the pillars; the two A-frames are attached to each other by inserting a retaining bolt or pin (not shown) in each of the holes 170 and engaging it with the adjacent pillar.

Each of the mini-flatracks 152, 154 has longitudinal beams 172 disposed beneath a load-bearing surface 174. As shown in FIG. 8A, these beams are made hollow so as to be able to receive a separate end frame which can then be securely coupled to the mini-flatrack 152. A suitable design of end frame for this purpose may be made based on the disclosure in our U.K. Published Patent Application No. 2 274 645. The mini-flatracks 152, 134 each have a pair of I.S.O. corner castings (three seen at 176, 178, 180). The spacing between castings 178 and 180 (and their counterparts on the other side) is arranged to be in accordance with the standard I.S.O. dimension for so-called "20 foot" (6 meter) containers and flatracks.

Referring now to FIGS. 10A–10E, there is illustrated in FIG. 10A a mini-flatrack 120 comprising an end-frame 122, and a load carrying base 142. The base 142 has the standard corner castings 124 at one and, and a connection means 126 at one corner on the other end. This flatrack is designed for connection with an identical flatrack in a free end to free end manner. As will be understood, the joined pair have four corner castings 124 at the four corners of the combination so enabling the pair of flatracks to be handled as a conventional "20 foot" I.S.O unit.

As seen in FIGS. 10A–10E, the end frame 122 comprises plate members 130 which are attached (e.g. welded) to hollow posts 132 and are also attached to longitudinal beams 134. Within each hollow column 132 a respective vertically slidable post 136 is located. These posts 136 support a hook bar 138 which extends between them.

The assembly constituted by the posts 136 and the bar 138 is vertically movable under the action of hydraulic or pneumatic rams 140, these rams being shown extended in FIGS. 10B and 10C and retracted in FIGS. 10D and 10E. In a preferred version of the invention, with the rams fully extended, the distance between the ground level datum GLD and the mid-point of the apex of the hook bar 138 is 1575 millimeters. In the contracted condition as seen in FIGS. 10D and 10E, the said distance is 1200 millimeters. The load carrying base 142 of the flatrack 120 is supported by longitudinal beams 144 and cross beams 146. As seen also in FIGS. 10B to 10D, standard corner castings 124 are located at the A-frame end of the flatrack 120. The feature of being able to readily alter the height of the hook bar 138, relative to ground level datum, is useful for a number of reasons, for example, when the flatrack, or the vehicle, is located on uneven ground, or when obstructions prevent the full ambit of movement of the hook arm of the load handling system.

I claim:

1. In combination with a load handling system mounted on a vehicle, a pair of mini-flatracks each having a length substantially half the length of an I.S.O. standard flatrack and also having one end and another end with an upstanding end-frame disposed at said one end, each of said mini-flatracks being characterized by said another end thereof having connecting means for rigidly connecting said mini-flatrack to the other one of said mini-flatracks to form an assembly which includes means for loading and unloading said assembly as a unit onto and from said vehicle, further characterized by said load handling system having a hook carried at the end of an L-shaped arm which is connected to a pivotal frame, said arm and said frame being arranged to pivot in a substantially vertical plane about respective pivot connections, whereby said assembly of mini-flatracks is loaded onto said vehicle over the rear end thereof.

2. The combination as defined in claim 1 further characterized by said connecting means including a spring-actuated connecting hook located at one side thereof and whereby said hook connects to the other mini-flatrack when the two mini-flatracks are aligned and moved towards each other.

3. The combination as defined in claim 2 further characterized by said connecting means being constructed so that the resulting assembly is substantially rigid in a longitudinal direction.

* * * * *